United States Patent [19]

Lewiner et al.

[11] 4,340,925

[45] Jul. 20, 1982

[54] SAFETY LOCKS

[76] Inventors: Jacques Lewiner, 5, rue Bory d'Arnex, 92210 Saint-Cloud; Claude Hennion, 18, rue Flatters, 75005 Paris, both of France

[21] Appl. No.: 226,761

[22] Filed: Jan. 21, 1981

[30] Foreign Application Priority Data

Jan. 25, 1980 [FR] France ..... 80 01673

[51] Int. Cl.[3] ..... H01H 47/00

[52] U.S. Cl. ..... 361/172; 70/278

[58] Field of Search ..... 361/171, 172; 70/278; 340/365 R

[56] References Cited

U.S. PATENT DOCUMENTS 3,749,930 7/1973 Roe ..... 361/172

3,889,501 6/1975 Fort ..... 361/172

3,941,955 3/1976 Gerber ..... 361/171

4,023,161 5/1977 Sasaki ..... 361/171 X

*Primary Examiner*—A. D. Pellinen

*Assistant Examiner*—L. C. Schroeder

*Attorney, Agent, or Firm*—Larson & Taylor

[57] ABSTRACT

The opening order of this safety lock causes the following operations to occur successively: application, to the key, of a coded sequence of angular solicitations in both directions, then the free rotation of this key in a given direction. The decoding is ensured electrically by comparing, with a previously memorized reference sequence, the train of electrical pulses generated by two electromechanical transducers actuated, according to the sequence applied to the key, by a cam itself driven by this key.

19 Claims, 8 Drawing Figures

SAFETY LOCKS

BACKGROUND OF THE INVENTION

1. Field of the Invention

The invention relates to combinations safety locks designed to equip the doors of strong rooms, safes and other safety enclosures, said locks including at least one bolt adapted to cooperate with a suitable clasp and at least one barrel adapted to receive a rotary actuating key.

It is directed more particularly, among these locks, to those whose actuation of the bolt requires prior unlocking of this bolt ensured by applying to the rotary key lodged in a barrel a sequence of solicitations or impulses at least angular whose characteristics (direction, number) correspond to at least one pre-determined code memorised in the lock.

2. Description of the Prior Art

In such locks, means are provided for exploiting for the decoding purposes the sequence of solicitations exerted on the key and to ensure the unlocking of the bolt in consequence.

In locks of the type indicated at present known, said exploitation means are of a mechanical type and hence constituted by complicated, bulky, heavy, fragile and expensive systems.

It is a particular object of the invention to render locks of the type concerned such that they avoid these drawbacks, that is to say that they are less bulky, less heavy, more economical and not less reliable as those previously known.

GENERAL DESCRIPTION OF THE INVENTION

Accordingly, locks of the type concerned according to the invention are essentially characterised in that the means used for exploiting for decoding purposes the sequence of solicitations exerted on the key are of electrical type, preferably with very low consumption.

In preferred embodiments, recourse is also had to one and/or another of the following features:

the decoding means comprise: at least two electromechanical transducers arranged and mounted so as to convert each into electrical signals of a given type the solicitations of a given type exerted on the key; an electronic unit adapted to compare the sequence of the signals of the different types generated by each actual sequence of solicitations exerted on the key with a reference code memorised in the lock; and electromechanical unlocking means for the bolt adapted to render possible the mechanical driving of this bolt when said sequence of signals corresponds to the reference code;

the solicitations exertable on the key are exclusively angular solicitations of identical amplitude and forces exerted from a same neutral position, some in a first direction and others in the opposite direction;

in a lock according to the preceding paragraphs, for which the number of transducers is two, there is provided a cam connected in rotation with the key when the latter is inserted into its actuating barrel, which cam is adapted to actuate respectively the two transducers for the two directions of angular solicitation of the key;

in a lock according to the preceding paragraph comprising a rod mechanically connected to the bolt, the two transducers are mounted on this rod so that, when the bolt is in any other position than its operating position (fully locked), the angular solicitations of the key do not ensure any actuation of these transducers;

in a lock of the above type with two transducers, the electronic comparison unit for the sequences of actual signals with the reference code includes a "change of side" selector sensitive to the successive changes in actuation of the two transducers, a pulse counter receiving the signals and the output from the selector, an address counter also receiving the output from the selector, a memory containing the reference code and receiving the output from the address counter and a comparator member receiving both the output from the memory thus "addressed" and that of the pulse counter;

the solicitations exertable on the key comprise axial solicitations, in addition to angular solicitations, and means for guiding the axial slidings of the key at several distinct angular positions;

the electromechanical unlocking means for the bolt comprise an electromagnet or electric motor arranged so that its energisation has the effect of releasing a latch urged constantly in a first direction, which latch, in its released position, ensures the unlocking concerned of the bolt, this latch being mounted so that its resetting, effected by its movement in the reverse direction from the first, is automatically ensured by the subsequent mechanical cycle of unlocking-locking;

in a lock according to the preceding paragraph comprising a part (shank or rod) connected mechanically to the bolt, the latch is mounted on this part so as to be displacable along this part and a locking finger, constituted notably by the core of the electro-magnet or by a part driven by the electric motor, is urged by a spring in the direction of the latch and of the part, so that for the position of the part corresponding to locking, the end of the finger is introduced into a hole of the part thereby locking the latter and holding the latch in its set position, so that the withdrawal of said finger ensuring the unlocking of the bolt is manifested by the projection of the latch between this finger and the part, then by support of the end of the finger against this latch, and so that the subsequent to-and-fro movement of the part is manifested successively by driving the latch disengaging it from between the finger and the part, which applies the end of the finger against the part beyond of the hole, then by resetting of the latch by the finger and finally by reinsertion of the end of the finger into the hole;

electromechanical unlocking means for the bolt comprise a clutch mounted between two members of the kinematic sequence of members interposed between the key and the bolt, which clutch is arranged so that it is normally disengaged for the locked position of the lock, the unlocking of the bolt being ensured by passage of said clutch into its engaged condition;

the lock comprises two electrical terminals, accessible from outside the latter arranged so as to permit its electrical energisation from an external source of direct current, and means for protection against overvoltages and against errors of connection;

the lock comprises means for activating or neutralising as desired the coding system so that the mechanical actuation of the bolt by means of the key, either requires the knowledge of the reference code, or on the other hand can be ensured without knowledge of this code;

in a lock according to the preceding paragraph comprising the above-indicated electromagnet, the latter is an electromagnet of the bistable type whose core is only movable in its two directions, by electromagnetic energisations;

in a lock according to the preceding paragraph but one, comprising the above-indicated electric motor, this motor is of an intermittent rotary type adapted to drive an arm itself mounted so as to be able to prevent undesirable reinsertion of the end of the above finger into the hole opposite the part, notably by direct cooperation of this arm with a lug fast to the finger;

the lock comprises means of the dynamo type arranged so as to convert certain angular movements of the key into sufficient electrical energy to ensure, after its possible accumulation in suitable members, the electrical energisation of the decoding and unlocking means of the lock;

the actuating means for the bolt after its unlocking are arranged so as to be driven by the key;

the lock according to the preceding paragraph comprises two separate barrels adapted to receive the key respectively for locking and unlocking of the bolt and for actuation of the latter;

the actuating means of the bolt after its unlocking are arranged so as to be actuated automatically, independantly of the key.

The invention comprises, apart from these main features, certain other features which are preferably used at the same time and which will be more explicitly considered below.

In the following, preferred embodiments of the invention will be described with reference to the accompanying drawings, given of course purely by way of non-limiting example.

DESCRIPTION OF PREFERRED EMBODIMENTS

Figure 1:
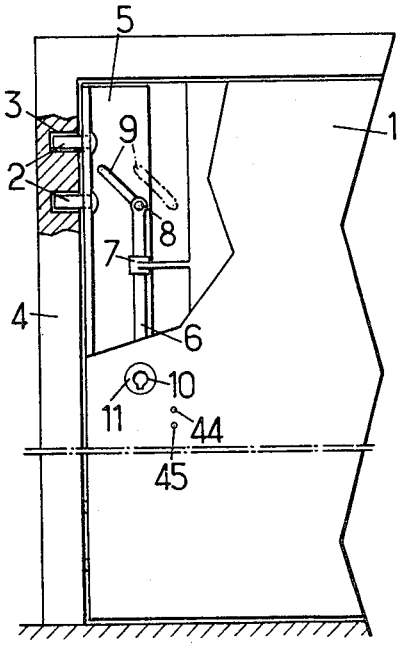
FIG. 1, of these drawings, shows diagrammatically, with portions torn away, a door to which is applicable a safety lock constructed according to the invention.

In a manner known in itself, the embodiment of the safety lock illustrated, mounted on a door 1 itself pivoting around a vertical axis (not shown), comprises at least one bolt 2 adapted to coact, for the closed position of the door, with a horizontal clasp 3 recessed opposite this bolt in the door frame 4 or in a part fast to this door frame.

The bolt 2 is fast to a vertical plate 5 called a bolt-holder, itself mounted in the door so as to be slidable horizontally but not vertically.

These slidings are actuated by the vertical movements of a rod 6 mounted in guides 7 themselves fast to the framework of the door, this rod itself bearing pins 8 adapted to coact with oblique oblong holes or ramps 9 recessed in the bolt-holder 5.

Finally, the operations of locking and of unlocking, that is to say the actuating of the horizontal movements of the bolt 2, are ensured by moving the rod 6 vertically, said bolt occupying its emerged, working, or "locked" position which cooresponds to the locking of the door when the rod 6 is in its extreme lower position illustrated in full lines in FIG. 1, and on the contrary its retracted, resting, or "unlocked" position corresponding to the opening of the door, when the rod is in its upper position to which corresponds the hole 9 shown in mixed lines in FIG. 1.

These operations are actuated by the rotations of a key inserted in the hole 10 of a barrel 11 itself mounted on the lock.

This hole can pass through the door if it is desired that the lock should be operable from both sides of the latter.

The above operations exploit the rotations of the key in well-determined directions, namely, for example, here the clock-wise direction for unlocking and the anti-clock-wise direction for locking.

These rotations are manifested advantageously, in manner known in itself, by those of a disc 12 with two pins 13, which axial disc is fixed on the door, the pins 13 (FIG. 2) being adapted to coact with the notches 14 of a rack in the form of a comb formed in the rod 6 (so-called "lantern type" mechanism).

Figure 2:
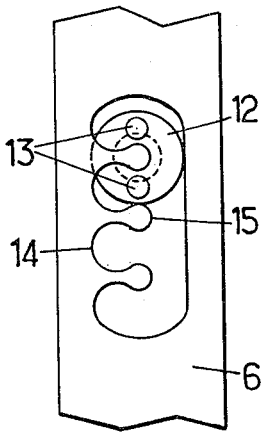
FIG. 2 shows a portion of this embodiment of a safety lock according to the invention.

So that the disc 12 may be slightly rotatable (for example 45 degrees to each side of its middle position) even if the rod 6 is locked vertically, the width of each notch 14 is given a value greater than the diameter of the pins 13 and/or a profile is given at least to the end tooth of the rack, straddled on the pins 13 for the fully locked state of the lock, of a special narrowed foot shape (see FIG. 2).

The rotations of the key which are necessary to actuate the above operations of the bolt, that is to say the rotations of large amplitude of this key (generally one or two turns), are not always possible, or again they are not always manifested by vertical movements of the rod.

In fact, for the locked state of the lock, as long as a secret code, known only to the owner of the key, has not been set on this lock and identified or decoded by it as correct, the rod 6 remains locked vertically, either a mechanical shackle opposing its movements, or a coupling system inserted between the key and said rod remaining disengaged.

The setting of the opening code on the lock is effected by exerting a sequence of angular solicitations on the key. These solicitations, which have identical amplitudes and forces, are exerted, some, in a first direction A and the others, in the opposite direction B: this sequence of solicitations is, for example, composed of three, four or five successive trains or "bursts" each including a pre-determined number (generally comprised between 1 and 9) of solicitations in a same direction, the directions of the angular solicitations composing successive trains being opposed step by step.

The exploitation of said sequence is here ensured not mechanically, namely by means of expensive and delicate spring catch systems, but electrically.

To this end, each of the solicitations concerned is manifested by the actuation of an electromechanical transducer 16 or 17, which actuation is adapted to generate an electrical pulse.

Each transducer 16 or 17 can be constituted in any desirable way adapted to convert the movement of a mechanical part into an electrical pulse. It is, for example, a switch connected in an electrical supply circuit (a switch bringing into play notably the cooperation of at least one conductive area of the key with at least two conductive balls housed in radial bores of the barrel and urged against the key by conductive springs, electrically connected to said circuit), or a member adapted to exploit, for the purposes of forming an electrical pulse, the variations of a contact pressure (electromechanical transducer proper), or that of a capacitor, which may or may not be equipped with an electret (case where the transducer may be denoted as of "electrostatic" type), or that again of a magnetic circuit adapted notably to generate a voltage by the Hall effect (electromagnetic transducer), etc.

To convert the above angular solicitations of the key into actuations, recourse is advantageously had to a cam 18 rotatable by this key, that is to say, connected angularly to the rotor of the lock, notably through three pinions 19, 20 and 21 in paired engagement.

Figure 3:
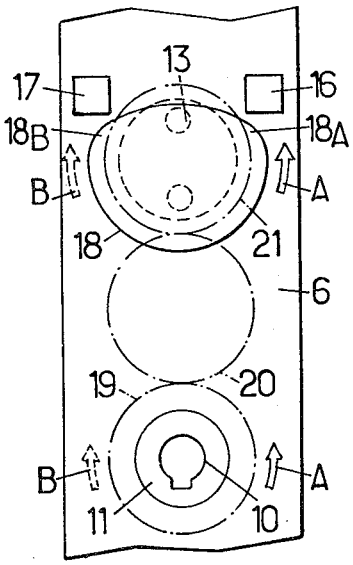
FIG. 3 shows another portion, constructed according to the invention, of said lock.

The profile of the cam 18, seen in FIG. 3, is entirely convex and has the shape of a circle from which a crescent with shortened corners has been removed.

This cam thus possesses two rounded bosses 18A and 18B having the double property:

of being able to actuate respectively the two transducers 16 and 17 on small angular movements of the cam, from its position shown in FIG. 3, respectively in the two directions A and B, so as to cause the generation by these transducers of the coded trains of pulses whose identification is necessary for the unlocking of the bolt 2, and of being movable angularly past, that is to say over the 360° of its angular track, said transducers when their selective actuation is no longer required for decoding purposes.

When the actuation of the transducers 16 and 17 brings into play a pressure or a contact of the cam 18 against the latter, it is convenient to reduce the risk of wear of these transducers by reason of the friction of this cam 18 against them on the integral passages of this cam necessary for the manipulations of the bolt.

It is then particularly advantageous, according to a preferred feature of the invention, to mount said transducers on the rod 6 itself: in this way, the latter are then out of harm from the cam for all states of the lock other than its total locking.

The sequence of electrical pulses generated by the transducers 16 and 17 is compared with a reference code previously recorded in an electronic unit. This unit is arranged so as to deliver an electrical signal S for unlocking the bolt when it is observed that there is conformity between the actual sequence of pulses due to the angular movements of the key and the reference code.

Figure 4:
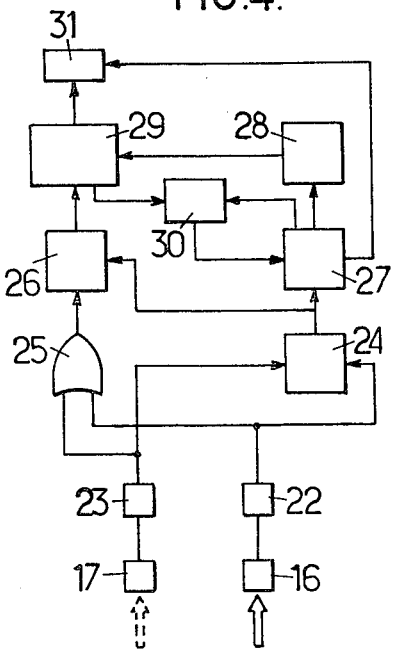
FIG. 4 shows an electronic decoding diagram of a lock according to the invention.

An advantageous embodiment of such an electronic "decoding" unit has been shown diagrammatically in FIG. 4.

This unit comprises:

two rebond eliminator circuits 22 and 23 associated respectively with the two transducers 16 and 17, a "change of side" flip-flop 24, receiving the outputs from these two circuits 22 and 23, arranged so as to swing over each time that it receives a pulse of a different type from that received just before and to emit a pulse each time that it swings, an AND gate 25 receiving, like the flip-flop 24, the output from the two circuits 22 and 23, a pulse counter 26 receiving the output from the gate 25 and reset to zero by the output of the flip-flop 24 on each "change of side", an address counter 27 also receiving the output from the flip-flop 24 and arranged so that its contents passes to 1 on reception of the first pulse of the sequence to be decoded and increases by 1 on each change of side, a memory 28—to the constitution of which we will come back below—in which has been recorded the reference code, which code is composed of a sequence of "address" members, this memory receiving the output from the address counter 27, a comparator 29 receiving both the output from the pulse counter 26 and that of the memory 28 on each modification of the contents of the address counter 27, a member 30 generating an error signal whose inputs are connected to the address counter 27 and to the comparator 29 and adapted to reset to zero the pulse counter 26 and said address counter 27 as soon as a manoeuver appears un correct, due to the fact notably of a fault in identity between the number of pulses of a train applied to the comparator 29 and the corresponding reference number then delivered by the memory 28, or again on passing beyond the number of addresses, or even exceeding the maximum time permitted for the decoding operation (for example 20 seconds), and an actuator 31 receiving the output from the address counter 27 and from the comparator 29 and adapted to form, in consequence, the unlocking signal S at the end of the decoding if the latter has been shown to be correct, if necessary after a slight delay, for example of the order of 0.5 to 1 second.

The wired "logic" unit constituted by the circuits 24 to 31 above, separate or integrated, could be replaced by a microprocessor programed logic unit: the latter construction has the advantage of a very small space, which permit its mounting in a small mortise recessed in the edge of the door concerned; it also has the advantage of a very small consumption, in particular when it is associated with means ensuring its automatic placing in "watching" or rather "sleeping" state after a certain period following the first decoding pulse: it is known, that, for each a state, the electrical consumption is practically zero, being limited to that just sufficient to preserve the memories; a special circuit is then, of course, provided to "awaken" the unit from the start of each decoding.

It is the signal S, formed by the actuator 31 at the end of correct decoding, which is exploited, with the aid of means consuming only a very small electrical power, to make possible the unlocking of the lock, either by mechanically unlocking the bolt 2 or more exactly the rod 6 mechanically connected to this bolt, if such a rod is provided, or by completing the mechanical linkage between the key introduced into the hole 10 of the lock and this bolt or this rod.

Figure 5:
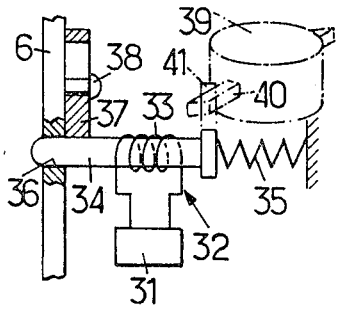
FIGS. 5, 6 and 7 show, respectively in three different states of its operation, an embodiment of a bolt-locking mechanism for a lock according to the invention.
Figure 6:
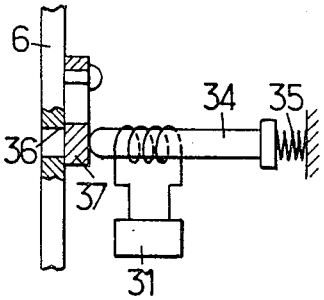
Figure 7:
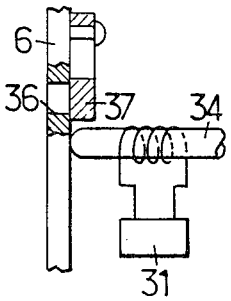

In the embodiment illustrated in FIGS. 5 to 7, the signal S is exploited to unlock the rod 6 mechanically.

For this purpose, recourse is had to an electro-magnet 32 whose winding 33 is connected to the actuator 31 so as to be able to be energised by the signal S and whose core 34 is constantly urged horizontally by a spring 35 in the direction of a hole 36 recessed in the rod 6.

A latch 37 is suspended from a rivet 38 planted in the rod so as to be able to be movable vertically with respect to the latter and to be able to occupy either a low position for which it closes the entrance of the hole 36, or a high position in which it frees this entrance.

The operation of this mechanism is as follows.

At rest, that is to say when the lock is in its locked position, the core 34 is inserted in the hole 36 (FIG. 5), which locks the rod 6 vertically.

The latch 37 is then in its relative upper position and rests on the core 34.

The production of the signal S has the result of energising the electro-magnet 32 and of moving its core to the right in FIG. 5 thereby compressing the spring 35, and this sufficiently to release the latch 37, which falls then by simple gravity and comes to occupy its lower position between the core 34 and the hole 36 (FIG. 6).

Immediately after this fall, the return force of the spring 35 pushes back the core 34 in the direction of the hole 36 and hence applies its end against the latch 37.

The vertical to-and-fro movement of the rod 6, which ensures the double operation of unlocking-locking, is then rendered possible.

It is this to-and-fro movement which automatically resets the system.

In fact, on the raising of the rod, the latch 37 drawn by it slides along the end of the core 34, then escapes from the gap comprised between this core and the hole 36: with this escape, the relaxation of the spring 35 pushes back the core against the rod 6 (FIG. 7) below the latch which again finds itself in its relative low position.

On the subsequent dropping of the rod, the latch 27 comes to rest on the core, which interrupts its descending travel whilst the hole 36 pursues its own until it arrives horizontally opposite the core: the latter then again penetrates therein and the system is reset, the rod then being locked vertically.

Instead of gravity, it would be possible to use the relaxation of a spring to urge the latch 37 towards its position inserted between rod and core.

In the same way, this latch could be directly mounted on a shank fast to the bolt 2, notably in the case where the lock does not include a rod.

Instead of using an electro-magnet of the monostable type to urge the above core 34 against the spring 35, it is possible to use an electric motor whose rotor is angularly drivable in a well-determined direction when it is supplied by an electric pulse, this rotor bearing a radial arm 40 adapted to cooperate with a lug 41 fast to a locking finger playing the part of the above core 34: this finger, still urged in the direction of locking the rod 6 by the above spring 35, is then no longer urged in the reverse direction by the energisation of a winding such as 33, but by thrusts of the arm 40 on its lug 41.

In a modification, the signal S does not actuate mechanical unlocking of the bolt: it energises a clutch inserted in the kinematic chain of members comprised between the rotary actuating key and the bolt, or more precisely between the rotary cylinder of the lock and the pin disc, so as to connect these various elements together mechanically, the normal state of said clutch, corresponding to the locked position of the lock, being its disengaged state for which the key turns "loosely" in the lock.

This clutch is advantageously provided at the level of the intermediate pinion 20 above, which is then composed of two identical elementary co-axial pinions respectively fast to coupling members which can be mutually declutched when the lock is locked and on the contrary mutually engaged for the manoeuvers of the bolt.

The mutual disengagement of these two members is automatically ensured at the end of each double manoeuver of unlocking-locking.

It may be advantageous in certain cases to momentarily neutralise the locking means preventing the key from actuating the bolt: in certain circumstances the user of the door can in fact wish to have the possibility of opening the door rapidly with the key without using the code.

Neutralisation means, controllable on the initiative of the user when the lock is open, are provided for this purpose.

Thus, in place of the "monostable" electro-magnet 32 of FIGS. 5 to 7, that is to say whose core is urged, in one direction by a spring and momentarily in the opposite direction by electromagnetism, it is possible to resort to an electro-magnet of the bistable type, that is to say whose solicitations of the core in the two directions call upon electromagnetism, this electro-magnet being able to be composed itself of two simple acting electro-magnets mounted so as to act in two opposite directions on a same core or movable mechanism: in the latter case, the control signal S above again ensures the locking of the lock, but it is necessary to apply to the electro-magnet a second signal to actuate the subsequent further locking of the lock.

This second signal may be automatically generated by the return of the rod into its starting position, for example by closing an electrical contact: it is then easy to provide means such as a simple switch mounted in series with said contact and accessible to the user only when the door is open, to prevent temporarily the production of the second signal.

In place of such an electro-magnet of bistable type, it would also be possible to resort to a motor 39 with a single arm such as that shown diagrammatically in FIG. 5, capable of occupying two stable angular positions displaced mutually by 180 degrees and of rotating by 180 degrees on each reception of an electric pulse: for one of these two positions, its arm 40 pushes back the lug 41 so as to disengage the locking finger 34 from the hole 36 and to hold it so disengaged, whereas, for its other position, the arm 40 is retracted out of the path of the lug 41, which again permits locking. In this case, the end of the arm 40 may be bevelled, as illustrated, so as to facilitate the escape of this arm at the end of the phases of driving the lug 41.

Numerous improvements other than those described above may be provided to improve the performance of the lock according to the invention.

Figure 8:
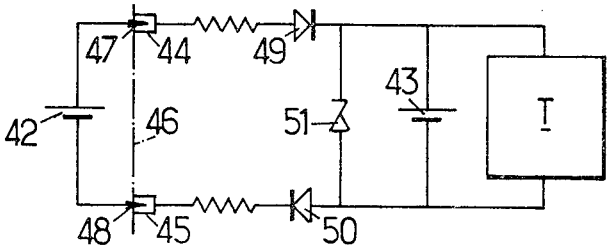
FIG. 8 is the electrical diagram of an improvement applicable with advantage to locks according to the invention.

In particular, it may be advantageous to provide, to supply electrically this lock—shown diagrammatically as a whole by the letter T in FIG. 8—the connection of an esternal source 42 of continuous direct current so as to remedy possible failures of the battery 43 normally provided for said supply.

This is the purpose of the electrical circuit which has been shown diagrammatically in FIG. 8: the female studs 44 and 45, open on the front surface 46 of the door (see also FIG. 1) are provided so as to receive male pins 47 and 48 connected to the emergency source 42.

Said circuit comprises in addition unidirectional means 49, 50 adapted to protect the unit against an error in the direction of connection of the emergency supply and protection means against overvoltages such as a Zener diode 51, a spark gap, a varistance, diodes . . .

It is also possible to provide means for monitoring the state of the battery 43 and automatically triggering certain actions when its charge passes below a threshold considered as unsufficient: such an action may be the neutralisation of the bolt locking means, so that the key holder remains able to open the door even when the battery is too weak; another such action, advantageously combined with the preceding one, may be the triggering of a signal adapted to warn the user of battery weakness at the moment when the latter opens the door with his key.

The electrical power consumed by the decoding and unlocking systems above is extremely low: thus in the watching state, the electrical circuits consume generally some microamperes only at some volts, and, in manipulations of decoding and unlocking, the electrical energy utilised is generally very much less than 0.05 joules.

Through this fact, it is possible to provide that the corresponding electrical energy be generated by the rotations of the key itself in the hole 10, this energy being produced by an apparatus of the dynamo type, then stored in a member of the capacitator type for its subsequent exploitation in the few seconds which follow.

In preferred embodiments, the above lock is arranged so that its reference code may be easily modified on the initiative of the key holder.

To this end, the memory 28 is selected to be of the type such that its content of numbers addressed may be easily replaced by another, or is mounted so that it can itself be easily replaced by another memory, when, of course, the door is open.

In the first case, the said memory may be constituted by modifiable contacts formed by means of switches or coding wheels. In a particularly advantageous embodiment relating to this first case, the memory is provided to be of a type such that its content may be modified electrically through a connector situated in a part, of the door, accessible only when the latter is open.

In the second case, the memory may be constituted by an electronic unit or by a system of conductive paths, of resistors, and/or of diodes, each of these solutions lending themselves to prior programing and to mounting in the form of a plugable box such as those usually manufactured in the field of integrated circuits.

In certain cases it may be advantageous to memorise several "hierarchised" separate opening codes, that is to say adapted to be neutralised by one another in decreasing order to the "hierarchy", on the closing of the door. If, for example, the hierarchy concerned comprises two codes A and B in decreasing order, the closing of the door according to code B enables subsequent opening of the door with any one of the two codes, but the closing according to code A neutralises the code B and thus only lends itself to a subsequent opening by code A.

To increase security, the rotor of the lock and its control key are themselves established as a function of one another in a manner difficult to identify and to imitate, as well known in the field of the locksmith.

The high degree of security confered on this lock by the requirements of decoding is hence added to that already confered on said lock by traditional techniques of safety locks mechanically actuatable by means of rotary keys.

As a result of which, and whatever the embodiment envisaged, there is finally provided a safety lock having numerous advantages over those of the same type at present known, is particular as regards the high degree of security, the low weight, the small bulk and the mechanical simplicity.

As is itself evident, and as emerges already from the foregoing, the invention is in no way limited to those of its types of application and embodiments which have been more especially envisaged; it encompasses, on the contrary, all modifications, notably:

those where certain of the successive angular solicitations exerted on the key would have different amplitudes from one another, these different amplitudes corresponding respectively to the actuation of different numbers of electromechanical transducers, a small amplitude being for example translatable by the actuation of a single transducer and a greater amplitude, by that of two transducers or of a number of transducers greater than two, those where the movements of the bolt would be controlled directly from the rotations of a member driven by the key, without passing through a rod, those where the movements of the bolt would be controlled again by the key, but after the insertion of the latter into a barrel of the lock other than that corresponding to the decoding, those where the movements of the bolt would be controlled, not from the key, but from a button or other manipulating member mounted permanently in the lock, those where the movements of the bolt would no longer be controlled manually, but automatically, and for example, electrically, by simple actuation of a control switch adapted to supply an electric motor whose shaft would be coupled to the pin disc 12 above, those where the sequence of solicitations exerted on the key for the purposes of decoding would comprise, in addition to the angular solicitations, at least one axial solicitation, said sequence being manifested for example, by several successive axial to-and-fro movements of the key in the hole of a same barrel of the lock, of which certain at least are separated from one another by angular displacements of the key around its axis, the barrel concerned then including, advantageously, on the one hand, radiating grooves to guide these various to-and-fro movements of the key by receiving in turn a same web of this key and, on the other hand, as many transducers associated with said grooves and mounted so as to be selectively actuated by these slidings of said web in these grooves.

We claim:

1. Safety lock comprising at least one bolt adapted to cooperate with a suitable bolt clasp and at least one barrel adapted to receive a rotary actuating key, the actuation of the bolt requiring prior unlocking of this bolt ensured by applying to the key lodged in a barrel a sequence of at least angular solicitations whose characteristics correspond to at least one pre-determined code memorised in the lock, means being provided to utilise for decoding purposes said sequence of solicitations and to ensure the consequent unlocking of the bolt, said means for utilising for decoding purposes the sequence of solicitations exerted on the key being of electrical type.

2. Lock according to claim 1, wherein the decoding means comprise: at least two electromechanical transducers arranged and mounted so as to convert the solicitations of a given type exerted on the key each into electrical signals of a given type; an electronic unit adapted to compare the sequence of signals of the different types generated by each actual sequence of solicitations exerted on the key with a reference code memorised in the lock; and electromechanical unlocking means for the bolt adapted to make possible the mechanical actuation of this bolt when said sequence of signals corresponds to the reference code.

3. Lock according to claim 2, for which the solicitations are exclusively angular solicitations of identical amplitudes and forces exerted from the same neutral position, some in a first direction and the others in the opposite direction, and for which consequently the number of transducers is two, said lock comprising a cam connected in rotation with the key when the latter is introduced into its actuating barrel, which cam is adapted to actuate respectively the two transducers for the two directions of angular solicitation of the key.

4. Lock according to claim 3, comprising a rod connected mechanically to the bolt, the two transducers being mounted on this rod so that, when the bolt is in another position than its fully locking position, the angular solicitations of the key do not ensure any actuation of these transducers.

5. Lock according to claim 3, wherein the electronic unit for comparing sequences of actual signals with the reference code includes a "change of side" selector sensitive to successive actuation changes of the two transducers, a pulse counter receiving the signals and the output from the selector, an address counter also receiving the output from the selector, a memory containing the reference code and receiving the output from the address counter and a comparator member receiving both the output from the memory thus "addressed" and that of the pulse counter.

6. Lock according to claim 3, wherein the electronic comparison unit for the sequences of actual signals with the reference code is constituted by a programed logic system (microprocessor).

7. Lock according to claim 1, wherein the angular solicitations exertable on the key comprise axial solicitations, in addition to the angular solicitations, and means for guiding the axial slidings of the key in several distinct angular positions.

8. Lock according to claim 2, wherein the electromechanical unlocking means of the bolt comprise an electro-magnet or electric motor arranged so that its energisation has the effect of releasing a latch urged permanently in a first direction, which latch, in its released position, ensures the unlocking concerned of the bolt, this latch being mounted so that its resetting, effected by its movement in the reverse direction from the first, is ensured automatically by the subsequent mechanical cycle of unlocking-locking.

9. Lock according to claim 8, comprising a part (shank or rod) mechanically connected to the bolt, wherein the latch is mounted on this part so as to be movable along this part and wherein a locking finger, constituted notably by the core of the electro-magnet or by a part driven by the electric motor, is urged by a spring in the direction of the latch and of the part so that, for the position of the part corresponding to locking, the end of the finger is inserted into a hole of the part by locking the latter and holding the latch in its set position, the withdrawal of said finger ensuring the unlocking of the bolt being manifested by the projection of the latch between this finger and the part, then by bearing of the end of the finger against this latch, and the subsequent to-and-fro movement of the part being manifested successively by a driving the latch disengaging it from between the finger and the part, which applies the end of the finger against the part on this side of the hole, then by resetting of the latch by the finger and finally by reintroduction of the end of the finger into the hole.

10. Lock according to claim 2, wherein the electromechanical unlocking means of the bolt comprise a clutch mounted between two members of the kinematic sequence of members interposed between the key and the bolt, which clutch is arranged so that it is normally disengaged for the locked position of the lock the unlocking of the bolt being ensured by the passage of said clutch into its engaged condition.

11. Lock according to claim 1, comprising two electrical terminals accessible from outside the latter, arranged so as to permit its electrical energisation from an external source of direct current, and protective means against overvoltages and against connection errors.

12. Lock according to claim 1, comprising means for activating or neutralising as desired the decoding system so that the actuation of the bolt, either requires a knowledge of the reference code, or, on the contrary, can be ensured without knowledge of this code.

13. Lock according to claim 8, comprising means for activating or neutralising as desired the decoding system so that the actuation of the bolt, either requires a knowledge of the reference code, or, on the contrary, can be ensured without knowledge of this code, and wherein the electromagnet is an electromagnet of the bistable type whose core is only movable, in its two directions, by electromagnetic energisation.

14. Lock according to claim 8, comprising means for activating or neutralising as desired the decoding system so that the actuation of the bolt, either requires a knowledge of the reference code, or, on the contrary, can be ensured without knowledge of this code, the electric motor being of an intermittent rotary type adapted to drive an arm itself mounted so as to be able to prevent undesirable reinsertion of the end of the finger above-mentioned in the facing hole of the part, notably by direct cooperation of this arm with a lug fast to this finger.

15. Lock according to claim 1, comprising means of the dynamo type arranged so as to convert certain angular movements of the key into sufficient electrical energy to ensure, after its possible accumulation in suitable members, the electrical energisation of decoding and unlocking means for the lock.

16. Lock according to claim 1, for which the actuating means for the bolt are arranged so as to be driven by the key, comprising two distinct barrels adapted to receive the key respectively for locking and unlocking of the bolt and for actuation of the latter.

17. Lock according to claim 1, wherein the actuating means for the bolt after its unlocking are arranged so as to be automatically actuated independently of the key.

18. Lock according to claim 1, comprising means for monitoring the state of wear of the battery and for triggering certain actions when its charge passes below a given threshold, actions such as the neutralisation of the locking means of the bolt.

19. Lock according to claim 1, comprising several "hierarchised" opening codes stored in the memory.

* * * * *